United States Patent [19]

Brown

[11] 4,114,537

[45] Sep. 19, 1978

[54] EXPLOSIVE DEVICE

[76] Inventor: Andrew James Brown, Five Oaks, Street Hey La., Willaston, Cheshire, England

[21] Appl. No.: 729,007

[22] Filed: Oct. 18, 1976

[51] Int. Cl.[2] ..... F42B 3/08

[52] U.S. Cl. ..... 102/24 HC

[58] Field of Search ..... 102/24 R, 24 HC, 56 SC

[56] References Cited

U.S. PATENT DOCUMENTS

| | | | |
|---|---|---|---|
| 2,797,892 | 7/1957 | Ryan | 102/24 HC |
| 2,984,307 | 5/1961 | Barnes | 102/24 HC |
| 3,348,482 | 10/1967 | Keener et al. | 102/24 HC |
| 3,613,582 | 10/1971 | Levamaki et al. | 102/24 HC |
| 3,771,460 | 11/1973 | Ayer | 102/24 R |
| 3,777,663 | 12/1973 | Brown | 102/24 HC |
| 3,783,788 | 1/1974 | Hayashi | 102/28 R |
| 3,972,285 | 8/1976 | Brown | 102/24 HC |

*Primary Examiner*—Verlin R. Pendegrass

[57] ABSTRACT

A trenching charge case having an upper casing part and lower casing part separately injection moulded from an electrically conductive plastics material, and formed with interengaging screw-threads to join the parts together with the cone of the case clamped between them, each of the parts of the casing being nestable with other like parts and the lower casing part comprising a depending wall to stand off the base of the cone from the surface to be excavated.

19 Claims, 1 Drawing Figure

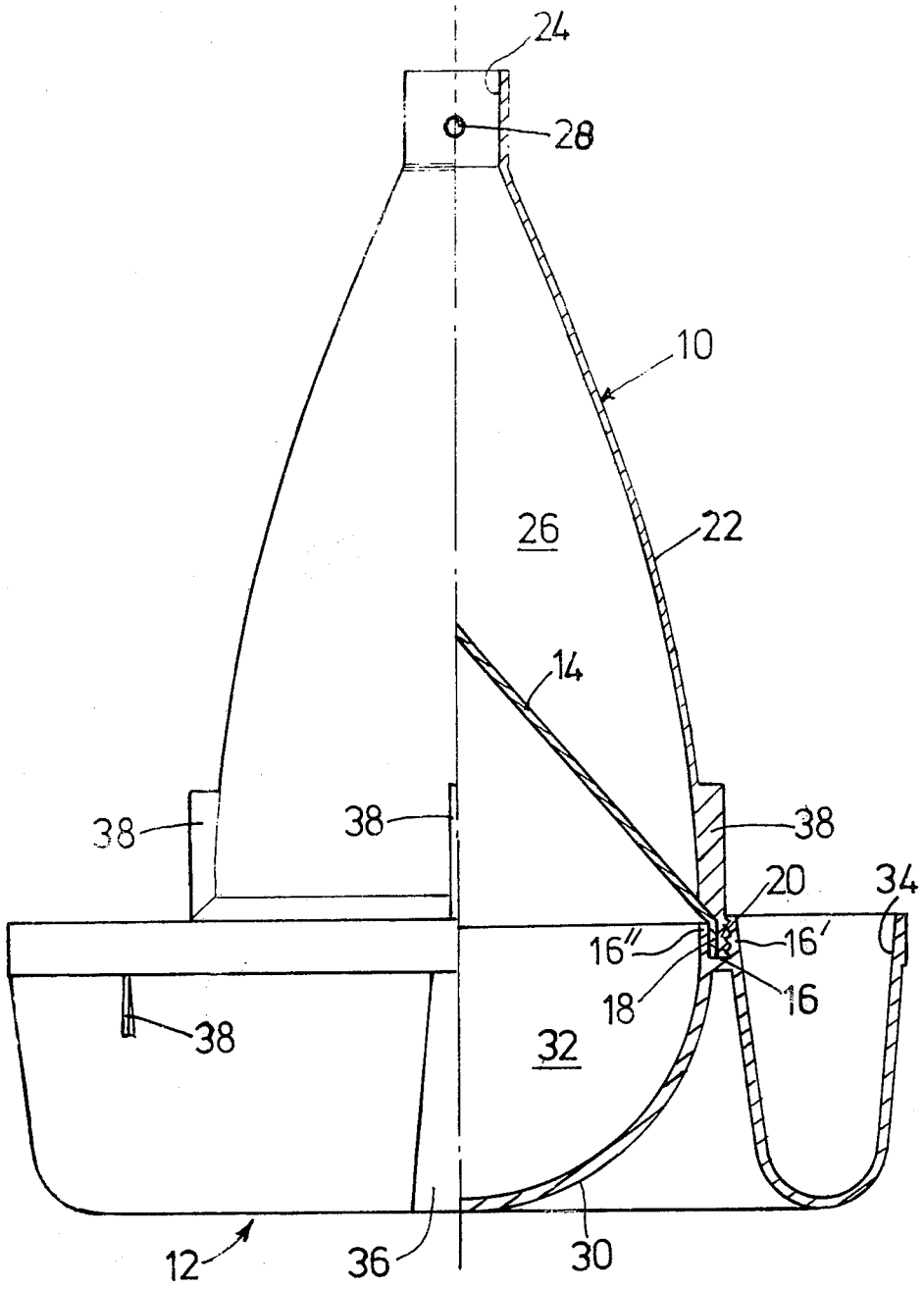
24
28
10
26
22
14
38
38
38
20
34
16″
16′
18
16
38
32
12
36
30

EXPLOSIVE DEVICE

The present invention relates to a trenching charge case used for excavating trenches and other cavities in the earth or seabed.

It is known to localize the effect of an explosion by the use of a charge case including a hollow metal cone around which explosive is packed and which is arranged with its open end directed towards the substrate to be excavated. Detonation of the explosive causes the cone to implode resulting in fragments of the cone being directed onto the substrate. The cone employed is of the type known as a ballistic cone or Monroe cone and has an included angle of substantially 80°.

In order to achieve the desired result, there should be an appreciable air space between the substrate and the open end of the cone and the charge of explosive must be contained sufficiently long to allow the cone to implode before the case disintegrates. Known trenching charge cases therefore comprise a hollow outer casing and a cone which divides the interior of the casing into two separate compartments, one of the compartments receiving the charge of explosive and the other constituting the air space. As such trenching charge cases are primarily for use on the seabed, they have been fabricated by welding so as to ensure that the joints used in the fabrication are watertight so that the cases have to be transported in their fully assembled and space-consuming state.

According to the present invention, there is provided a trenching charge case having an outer casing and a hollow cone, in which the outer casing comprises upper and lower casing parts having interengageable fastening means which enable the parts to be joined together to form the outer casing with the cone mounted within the casing between the upper and lower parts to lie with the apex of the cone within the upper casing part, so as to divide the interior of the casing into two separate compartments, and in which the lower casing part comprises a wall located to depend below the lower edge of the cone, when joined together with the outer casing, to support the case against a surface to be excavated so as to stand-off the lower edge of the cone from that surface.

In a preferred embodiment of the invention, the cone is clamped between the upper and lower casing parts when the two parts are fastened together. The interengagable fastening means preferably comprises an annular extension on one of the parts and an annular recess in the other of the parts, the recess receiving the annular extension and a peripheral region of the cone. The annular extension and annular recess are preferably formed with complementary screw threads by which the two parts of the casing are secured together. A sealing member may, if necessary, be provided in the recess or a sealing compound such as a waterproof mastic composition may be employed to ensure a watertight connection between the casing parts.

While the cone will normally be formed of metal, typically steel, one or other or both of the casing parts may be formed of a plastics material. At least the upper part of the casing, into which explosive is introduced, is rendered electrically conducting by, for example, the incorporation of carbon into the plastics composition to avoid electrical sparking arising from build-up of static.

The use of plastics for the casing parts permits the parts to be configured so as to produce optimum results, production of the casing parts by, for example, injection moulding, providing scope for the mass-production of parts which could not readily be fabricated from sheet metal.

BRIEF DESCRIPTION OF THE DRAWINGS

The invention is further described, by way of example, with reference to the accompanying drawing which is a side elevation, partly in section, of an underwater trenching charge case constructed in accordance with the invention.

DETAILED DESCRIPTION OF THE INVENTION

The charge case shown in the drawing is formed from three components, an upper casing part 10, a lower casing part 12 and a hollow cone 14. The casing parts 10 and 12 are injection moulded from a plastics material which is rendered electrically conductive by the incorporation of elemental carbon and the cone 14 is formed of a metal, typically steel. The lower casing part 12 has an annular recess 16 to receive a depending peripheral flange 18 of the cone 14 and a depending flange 20 of the upper housing part 10, bearing a screw-thread on its outer face. It may be seen that the recess comprises a radially outer wall 16' bearing a screw-thread on its radially inner face, and a radially inner wall 16'' with the two walls being spaced apart by a distance such that, with the depending flange of the cone entered in the recess to abut against the radially outer face of wall 16'', the depending flange can be screwed into the recess by mutual interengagement of the screw-thread on the upper casing part and the screw-thread on the radially outer wall of the recess to join the two casing parts 10 and 12 together with the peripheral flange 18 of the cone clamped between the flange 20 and the wall 16'' of the recess 16. A sealing member (not shown) may be positioned in the recess 16 or a sealing compound such as a mastic composition may be used to ensure a watertight seal between the two casing parts.

At the top of the upper casing part 10, which has an outwardly bowed frusto-conical wall 22, is an opening 24 through which a charge of explosive may be introduced into the space 26 between the wall 24 and cone 14 and which may be closed by a resilient bung (not shown). Diametrically opposed holes 28 are provided near to the top of the upper casing part for co-operation with a clamp (not shown) by which the casing may be manipulated into position.

The lower casing part 12 has a substantially hemispherical wall 30 which defines with the cone 14 an air space 32. Around the exterior of the wall 30 is an annular trough 34 which is interrupted at two diametrically opposed regions 36 for rigidity and which is filled with ballast such as concrete when the charged case is to be used; the dimension, in the axial direction of the case, of the trough and the hemispherical wall being substantially the same.

The cone 14 is of the type known as a ballistic cone or Monroe cone and has an included angle of substantially 80°. When the charge case is positioned on the seabed over an area to be excavated and the charge of explosive in the compartment 26 is detonated, the cone 14 will implode, the fragments of the cone having a substantial component of velocity in the downward direction. The walls 22 and 30 will also rupture but the wall 22 which confines the explosive charge and which is acted upon by external hydrostatic pressure is designed to contain the explosion at least until the cone 14 has fragmented.

For use on dry land, the hemispherical wall 30 and ballast trough 34 may be omitted and replaced by a cylindrical or frusto-conical wall (not shown) extending downward from the recess 16. The wall 22 of the upper housing part may, if necessary, be reinforced to compensate for the absence of external hydrostatic pressure.

The invention therefore provides a trenching charge case which is formed of a small number of easily-manufactured components and which may be supplied to a customer in component form. Each of the components of the illustrated embodiment is designed to be nestable with other identical components so that a set of components for several charge cases occupies only a small total volume. The two outer casing components are integrally formed with projections 38 to prevent jamming together of the nested parts.

I claim:

1. A trenching case comprising:

a. an outer casing; the outer casing comprising an upper casing part and a lower casing part;

b. a hollow cone fitting within the upper casing part, and c. interengageable fastening means to enable the upper casing part and the lower casing part to be joined together to form the outer casing with the cone mounted between the upper and lower parts thereof to lie with the apex of the cone within the upper part of the casing to divide the interior of the casing into two separate compartments, a single piece annular ballast trough structure integrally formed with said lower casing part and surrounding the lower casing part, the lower casing part comprising a wall located to depend below the lower edge of the cone, when joined together with the outer casing, to support the case against a surface to be excavated so as to stand-off the lower edge of the cone from that surface.

2. A trenching charge case as claimed in claim 1, wherein the depending wall is of a generally hemispherical form directed outwardly of the case and having substantially the same dimension in the axial direction of the case as the ballast trough, whereby the case may be supported against said surface by the underside of the trough and by the exterior of the hemispherical wall at the apex thereof.

3. A trenching charge case comprising:

a. an outer casing, the outer casing comprising an upper casing part and a lower casing part;

a hollow cone positioned within the upper casing part and defining an annular depending flange at the peripheral edge of the cone, and c. interengageable fastening means for connecting the upper casing part and the lower casing part; said means comprising a depending annular flange formed at the lower edge of the upper casing part and being screw-threaded on its exterior face, an annular recess formed on the exterior of the lower casing part at the upper edge thereof and providing a radially inner wall and a radially outer wall bearing a screw-thread on its radially inner face, said two walls of the recess being radially spaced apart by a distance such that, with the depending flange of the cone entered in the recess to abut against the radially outer face of the radially inner wall, the depending flange of the upper casing part can be screwed into the recess by mutual interengagement of the screw-thread on the flange of the upper casing part and the screw-thread on the radially outer wall of the recess, to join the two casing parts together to form the outer casing with the depending flange of the cone clamped between them with the apex of the cone extending into the upper casing part, to divide the interior of the casing into two compartments.

4. A trenching charge case as claimed in claim 3, wherein, in the assembled outer casing, means are provided to seal said recess against the ingress of dirt or moisture.

5. A trenching charge case as claimed in claim 4, wherein said seal means comprises a seal member.

6. A trenching charge case as claimed in claim 4, wherein said seal means consists of a sealing compound.

7. A trenching charge case as claimed in claim 6, wherein said sealing compound is a mastic composition.

8. A trenching charge case comprising:

a. an outer casing, the outer casing comprising an upper casing part and a lower casing part;

b. a hollow cone positioned within the upper casing part, and c. interengageable fastening means to enable the upper casing part and the lower casing part to be joined together to form the outer casing with the cone mounted between the upper and lower casing parts thereof so that the apex of the cone lies within the upper casing part to divide the interior of the casing into two compartments; at least one of the upper casing part and lower casing part being formed of a plastics material having incorporated therein elemental carbon so as to render the material electrically conductive and an annular ballast trough integrally formed with the lower casing part and disposed around the lower casing part and interrupted at diametrically opposed parts for rigidity.

9. A trenching charge case as claimed in claim 8, wherein both the upper casing part and the lower casing part are parts injection moulded from plastics material.

10. A trenching charge case comprising:

a. an outer casing, the outer casing comprising an upper casing part and a lower casing part;

b. a hollow cone fitting within the upper casing part, and c. interengageable fastening means to enable the upper casing part and the lower casing part to be joined together to form the outer casing with the cone mounted between the upper casing part and the lower casing part, the apex of the cone lying within the upper casing part to divide the interior of the casing into two compartments, said cone being formed with an annular dependent flange on its peripheral edge, and said interengaging means comprising a depending annular flange formed at the lower edge of the upper casing part screw-threaded on its exterior face, and an annular recess defined on the exterior upper edge of the lower casing part to form a radially outer wall bearing a screw-thread on its inner face, and a radially inner wall spaced apart a distance to allow the depending flange of the cone to be received in the recess and abut against the radially outer face of the radially inner wall, said depending flange of the upper casing part when screwed into the recess by mutual interengagement of the screw-thread on the flange of the upper casing part and the screw-thread on the radially outer wall of the recess, to join the two casing parts together to form the outer casing, clamping the depending flange of the cone between them so that the apex of the cone extends into the upper casing part to divide the interior of the casing into two compartments; said two casing parts being formed so as to be nestable in other like parts.

11. A trenching charge case as claimed in claim 10, wherein the exterior of at least one of the lower casing and upper casing parts is provided with exterior projections to prevent a plurality of the casing parts when nested from jamming together.

12. A trenching charge case as claimed in claim 10, wherein the upper casing part and the lower casing part are formed of plastics material incorporating elemental carbon to render the parts electrically conducting.

13. A trenching charge case as claimed in claim 12, wherein the upper and lower casing parts are injection moulded parts.

14. A trenching charge case as claimed in claim 10, further comprising an annular ballast trough secured to disposed around the lower casing part and interrupted at diametrically opposed parts for rigidly.

15. A trenching charge case as claimed in claim 12 wherein said upper and lower casing parts are formed so that each is nestable with other like parts.

16. A trenching charge case as claimed in claim 10, wherein said lower casing part has a depending wall of frusto-conical form with the end remote from the cone being the end of the wider diameter.

17. A trenching charge case as claimed in claim 16, further comprising an annular ballast trough disposed around the lower casing part and integral therewith, with said depending wall being of a generally hemispherical form directed outwardly of the case and having substantially the same dimension in the axial direction of the case as the ballast trough.

18. A trenching charge case as claimed in claim 17, wherein at least one of said upper casing part and said annular ballast trough is provided with projections on the exterior thereof to prevent a plurality of the casing parts, when nested, from jamming together.

19. A trenching case comprising:

a. an outer casing, the outer casing comprising an upper casing part and a lower casing part;

b. a hollow cone fitting within the upper casing part, and c. interengageable fastening means found on said upper casing part and said lower casing part comprising thread means to enable the upper casing part and the lower casing part to be screwed together to form the outer casing with the cone mounted between the upper and lower parts thereof and clamped by said parts to lie with the apex of the cone within the upper part of the casing to divide the interior of the casing into two separate compartments, an annular ballast trough integrally formed with said lower casing part and surrounding the lower casing part, the lower casing part comprising a wall located to depend below the lower edge of the cone, when joined together with the outer casing, to support the case against a surface to be excavated so as to stand-off the lower edge of the cone from that surface.

* * * * *